US009540848B1

(12) United States Patent
Wu

(10) Patent No.: US 9,540,848 B1
(45) Date of Patent: Jan. 10, 2017

(54) DOOR LOCK PERMITTING EASY CHANGE IN LOCK CORE ASSEMBLY ORIENTATION

(71) Applicant: I-TEK METAL MFG. CO., LTD, Tainan (TW)

(72) Inventor: Chang-Ren Wu, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 0 days.

(21) Appl. No.: 14/997,615

(22) Filed: Jan. 18, 2016

(51) Int. Cl.

| | |
|---|---|
| ***E05B 13/10*** | (2006.01) |
| ***E05B 63/04*** | (2006.01) |
| ***E05B 55/00*** | (2006.01) |
| ***E05B 3/00*** | (2006.01) |
| ***E05B 65/06*** | (2006.01) |
| *E05B 9/08* | (2006.01) |

(52) U.S. Cl.
CPC ..... *E05B 63/04* (2013.01); *E05B 3/00* (2013.01); *E05B 55/005* (2013.01); *E05B 65/06* (2013.01); *E05B 9/084* (2013.01); *E05B 13/108* (2013.01); *Y10T 70/7661* (2015.04)

(58) Field of Classification Search
CPC ..... E05B 63/04; E05B 65/06; E05B 3/00; E05B 55/005; E05B 3/003; E05B 9/08; E05B 9/084; E05B 9/086; E05B 13/108; Y10T 70/7661; Y10T 70/765; Y10T 70/7655
USPC ..... 70/215, 216, 461, 224, 367–374, 381,70/462, 466, DIG. 31, DIG. 39
See application file for complete search history.

(56) References Cited

U.S. PATENT DOCUMENTS

| | | | | | |
|---|---|---|---|---|---|
| 3,541,820 | A * | 11/1970 | Best | E05B 9/084 | 70/369 |
| 3,541,821 | A * | 11/1970 | Best | E05B 9/084 | 70/369 |
| 4,052,868 | A * | 10/1977 | Best | E05B 55/005 | 292/347 |
| 4,312,201 | A * | 1/1982 | Roos | E05B 55/005 | 70/224 |
| 4,995,249 | A * | 2/1991 | Preissler | E05B 9/084 | 70/224 |
| 5,398,531 | A * | 3/1995 | Shen | G06T 7/001 | 257/E21.53 |
| 5,752,399 | A * | 5/1998 | Shen | E05B 3/003 | 292/348 |
| 6,360,570 | B1 * | 3/2002 | Shen | E05B 9/084 | 70/224 |
| 6,412,319 | B1 * | 7/2002 | Adelmeyer | E05B 1/0007 | 292/347 |
| 8,136,375 | B2 * | 3/2012 | Shen | E05B 9/084 | 70/224 |

(Continued)

*Primary Examiner* — Lloyd Gall
(74) *Attorney, Agent, or Firm* — Alan D. Kamrath; Kamrath IP Lawfirm, P.A.

(57) ABSTRACT

A door lock (10) includes a driving device (30) having an outer spindle (36) and an outer handle (38) mounted to the outer spindle (36). A mounting member (56) is rotatably mounted in a compartment (46) of the outer handle (38). A positioning member (72) is movably received in a groove (54) of the outer handle (38). When a lock core (74) disengages from the mounting member (56), the mounting member (56) cannot move along a longitudinal axis but can pivot about a pivotal axis relative to the outer handle (38) to change a positional relationship between first and second holes (64, 66) of the mounting member (56). After the lock core (74) engages with the mounting member (56), the mounting member (56) cannot pivot about the pivotal axis relative to the outer handle (38).

12 Claims, 11 Drawing Sheets

(56) References Cited

U.S. PATENT DOCUMENTS

| | | | | |
|---|---|---|---|---|
| 8,978,426 | B2 * | 3/2015 | Wang | E05B 67/36 70/14 |
| 2002/0026817 | A1 * | 3/2002 | Greer | E05B 9/084 70/370 |
| 2007/0186599 | A1 * | 8/2007 | Hsueh | E05B 3/003 70/224 |
| 2008/0276669 | A1 * | 11/2008 | Shen | E05B 9/084 70/224 |

* cited by examiner

DOOR LOCK PERMITTING EASY CHANGE IN LOCK CORE ASSEMBLY ORIENTATION

BACKGROUND OF THE INVENTION

The present invention relates to a door lock permitting easy change in the lock core assembly orientation and, more particularly, to a door lock permitting an assembly orientation of a lock core of the door lock to be adjusted to the correct assembly orientation no matter the door is right-handed or left-handed, such that the orientation of the key inserted by the user is the same.

Doors are classified into left-handed type and right-handed type according to the type of the wall separating spaces. A left-handed door has a side end pivotably mounted to a door frame, and a door lock is mounted to a right side of the left-handed door, permitting opening and closing by the right side of the left-handed door. A right-handed door has a right side pivotably mounted to a door frame, and a door lock is mounted to a left side of the right-handed door, permitting opening and closing by the left side of the right-handed door. A pivotal direction of a lock core of the door lock mounted to the left side of the door is opposite to a pivotal direction of a lock core of the door lock mounted to the right side of the door, such that the orientation of the keyway of the lock core of the door lock mounted to the left side of the door is opposite to the orientation of the lock core of the door lock mounted to the right side of the door. Thus, the direction of rotating a key for unlocking the door lock could be different, too.

Replaceable figure 8-shaped lock cores have been proposed by manufacturers to solve this problem. Specifically, two keys are provided for a figure 8-shaped lock core, one of which can be used to unlock the door lock, and the other can be used to detach the lock core from the door lock to permit a change in the assembly orientation of the lock core. However, the cross sections of the figure-8 shaped lock cores are not circular, such that the cross sections of a compartment for receiving the lock core is not circular, either. Thus, in addition to detaching the lock core, the outer handle must be detached from the door lock for changing the assembly orientation of the lock core. Namely, the outer handle is reassembled to the correct direction (i.e., the opposite direction), and the lock core is recoupled to the outer handle. Furthermore, to achieve an anti-theft effect, the outer handle cannot be directly detached unless the components in the inner handle are detached. Thus, the assembly orientation of the lock core cannot be changed when only the lock core is detached, leading to insufficient utility.

BRIEF SUMMARY OF THE INVENTION

In a first aspect, a door lock includes a driving device having an outer spindle pivotable about a pivotal axis. A latch device is operably connected to the driving device and includes a latch. Pivotal movement of the outer spindle about the pivotal axis causes movement of the latch between a latching position and an unlatching position. An outer handle includes an outer end and an inner end spaced from the outer end along a longitudinal axis. The outer handle further includes a compartment extending from the outer end towards but spaced from the inner end of the outer handle. The compartment includes an inner periphery having a groove. The outer handle further includes an axial hole extending from the inner end of the outer handle and intercommunicating with the compartment. The outer handle is coupled to and jointly pivotable with the outer spindle. A mounting member is rotatably mounted in the compartment of the outer handle and includes a first end face and a second end face spaced from the first end face along the longitudinal axis. The mounting member further includes a first hole extending from the first end face through the second end face and aligned with the axial hole of the outer handle. The mounting member further includes a second hole extending from the first end face through the second end face. The second hole is located on a side of and intercommunicates with the first hole. A positioning member is movably received in the groove of the outer handle. The positioning member permits the mounting member to pivot about the pivotal axis and prevents the mounting member from moving relative to the outer handle along the longitudinal axis. A lock core includes a first portion and a second portion adjoining and extending parallel to the first portion. The lock core is detachably engaged with the mounting member.

When the lock core engages with the mounting member, the first portion of the lock core is received in the first hole of the mounting member, and the second portion of the lock core is received in the second hole of the mounting member, preventing the mounting member from pivoting about the pivotal axis relative to the outer handle.

When the lock core disengages from the mounting member, the mounting member is pivotable about the pivotal axis relative to the outer handle to change a positional relationship between the first and second holes of the mounting member.

In an example, the mounting member further includes an outer periphery extending between the first and second end faces of the mounting member. The mounting member further includes a through-hole extending from an inner periphery of the second hole in a radial direction perpendicular to the pivotal axis through the outer periphery of the mounting member. The through-hole is aligned with the groove of the outer handle. The positioning member includes a first end securely received in the through-hole and a second end slideably received in the groove of the outer handle.

In a second example, the positioning member moves through the through-hole into a space formed by the annular groove of the mounting member and the groove of the outer handle.

In an example, each of the first and second holes has a central axis. The central axes of the first and second holes spaced from each other in a spacing direction. The through-hole has a central axis at a non-parallel angle to the spacing direction.

The lock core can include a positioning sleeve configured to be unlocked and pivoted by a key. The positioning sleeve includes a lug formed on an outer periphery thereof. The key can be operated to pivot the lug between an extended, engagement position and a retracted, detachment position. When the lug is in the extended, engagement position, the lug abuts the second end face of the mounting member to prevent the lock core from disengaging from the mounting member along the longitudinal axis, thereby positioning the lock core. When the lug is in the retracted, detachment position, the lug is spaced from the second end face of the mounting member to permit the lock core to move relative to the mounting member along the longitudinal axis, disengaging the lock core from the mounting member.

The outer spindle can further include a first insertion groove and a second insertion groove spaced from the first insertion groove by 180° in a circumferential direction about the pivotal axis. When the lug is in the extended, engagement position, the lug abuts an inner wall of one of the first and second insertion grooves to prevent the lock core from disengaging from the mounting member along the longitudinal axis, thereby positioning the lock core. When the lug is in the retracted, detachment position, the lug is spaced from the inner walls of the first and second insertion grooves to permit the lock core to move relative to the mounting member along the longitudinal axis, disengaging the lock core from the mounting member and the outer spindle.

In a second aspect, a door lock includes a driving device having an outer spindle pivotable about a pivotal axis. The driving device is adapted to be mounted to a door having a first end face and a second end face opposite to the first end face. The door further includes a first side extending between the first and the second end faces. The outer spindle has a distal end located on an outer end of the first side of the door. A latch device is operably connected to the driving device and includes a latch. Pivotal movement of the outer spindle causes movement of the latch between a latching position and an unlatching position. The latch device is configured to be mounted to one of the first and second end faces of the door. An outer handle includes an outer end and an inner end spaced from the outer end along a longitudinal axis of the outer spindle. The outer handle further includes a compartment extending from the outer end towards but spaced from the inner end of the outer handle. The compartment includes an inner periphery having a groove. The outer handle further includes an axial hole extending from the inner end of the outer handle and intercommunicating with the compartment. The outer handle is coupled to and jointly pivotable with the outer spindle. A mounting member is rotatably mounted in the compartment of the outer handle. The mounting member includes a first end face and a second end face spaced from the first end face along the longitudinal axis. The mounting member further includes a first hole extending from the first end face through the second end face and aligned with the axial hole of the outer handle. The mounting member further includes a second hole extending from the first end face through the second end face. The second hole is located on a side of and intercommunicates with the first hole. A positioning member is movably received in the groove of the outer handle. The positioning member permits the mounting member to pivot about the pivotal axis and prevents the mounting member from moving relative to the outer handle along the longitudinal axis. A lock core includes a first portion and a second portion adjoining and extending parallel to the first portion. The lock core is detachably engaged with the mounting member.

When the lock core engages with the mounting member, the first portion of the lock core is received in the first hole of the mounting member, and the second portion of the lock core is received in the second hole of the mounting member, preventing the mounting member from pivoting about the pivotal axis relative to the outer handle to change a positional relationship between the first and second holes of the mounting member. When the lock core disengages from the mounting member, the mounting member is pivotable about the pivotal axis relative to the outer handle.

When the latch device is mounted to the first end face of the door, the second portion of the lock core is located right below the first portion of the lock core in a vertical direction perpendicular to the pivotal axis. When the latch device is mounted to the second end face of the door, the second portion of the lock core is located right below the first portion of the lock core in a vertical direction perpendicular to the pivotal axis.

In an example, the mounting member further includes an outer periphery extending between the first and second end faces of the mounting member. The mounting member further includes a through-hole extending from an inner periphery of the second hole in a radial direction perpendicular to the pivotal axis through the outer periphery of the mounting member. The through-hole is aligned with the groove of the outer handle. The positioning member includes a first end securely received in the through-hole and a second end slideably received in the groove of the outer handle.

In a second example, the positioning member moves through the through-hole into a space formed by the annular groove of the mounting member and the groove of the outer handle.

In an example, each of the first and second holes has a central axis. The central axes of the first and second holes spaced from each other in a spacing direction. The through-hole has a central axis at a non-parallel angle to the spacing direction.

The lock core can include a positioning sleeve configured to be unlocked and pivoted by a key. The positioning sleeve includes a lug formed on an outer periphery thereof. The key can be operated to pivot the lug between an extended, engagement position and a retracted, detachment position. When the lug is in the extended, engagement position, the lug abuts the second end face of the mounting member to prevent the lock core from disengaging from the mounting member along the longitudinal axis, thereby positioning the lock core. When the lug is in the retracted, detachment position, the lug is spaced from the second end face of the mounting member to permit the lock core to move relative to the mounting member along the longitudinal axis, disengaging the lock core from the mounting member.

The outer spindle can further include a first insertion groove and a second insertion groove spaced from the first insertion groove by 180° in a circumferential direction about the pivotal axis. When the lug is in the extended, engagement position and the latch device is mounted to the first end face of the door, the lug abuts an inner wall of the first insertion groove to prevent the lock core from disengaging from the mounting member along the longitudinal axis, thereby positioning the lock core. When the lug is in the extended, engagement position and the latch device is mounted to the second end face of the door, the lug abuts an inner wall of the second insertion groove to prevent the lock core from disengaging from the mounting member along the longitudinal axis, thereby positioning the lock core. When the lug is in the retracted, detachment position and the latch device is mounted to the first end face of the door, the lug is spaced from the inner wall of the first insertion groove to permit the lock core to move relative to the mounting member along the longitudinal axis, disengaging the lock core from the mounting member and the outer spindle. When the lug in the retracted, detachment position and the latch device is mounted to the second end face of the door, the lug is spaced from the inner wall of the second insertion groove to permit the lock core to move relative to the mounting member along the longitudinal axis, disengaging the lock core from the mounting member and the outer spindle.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
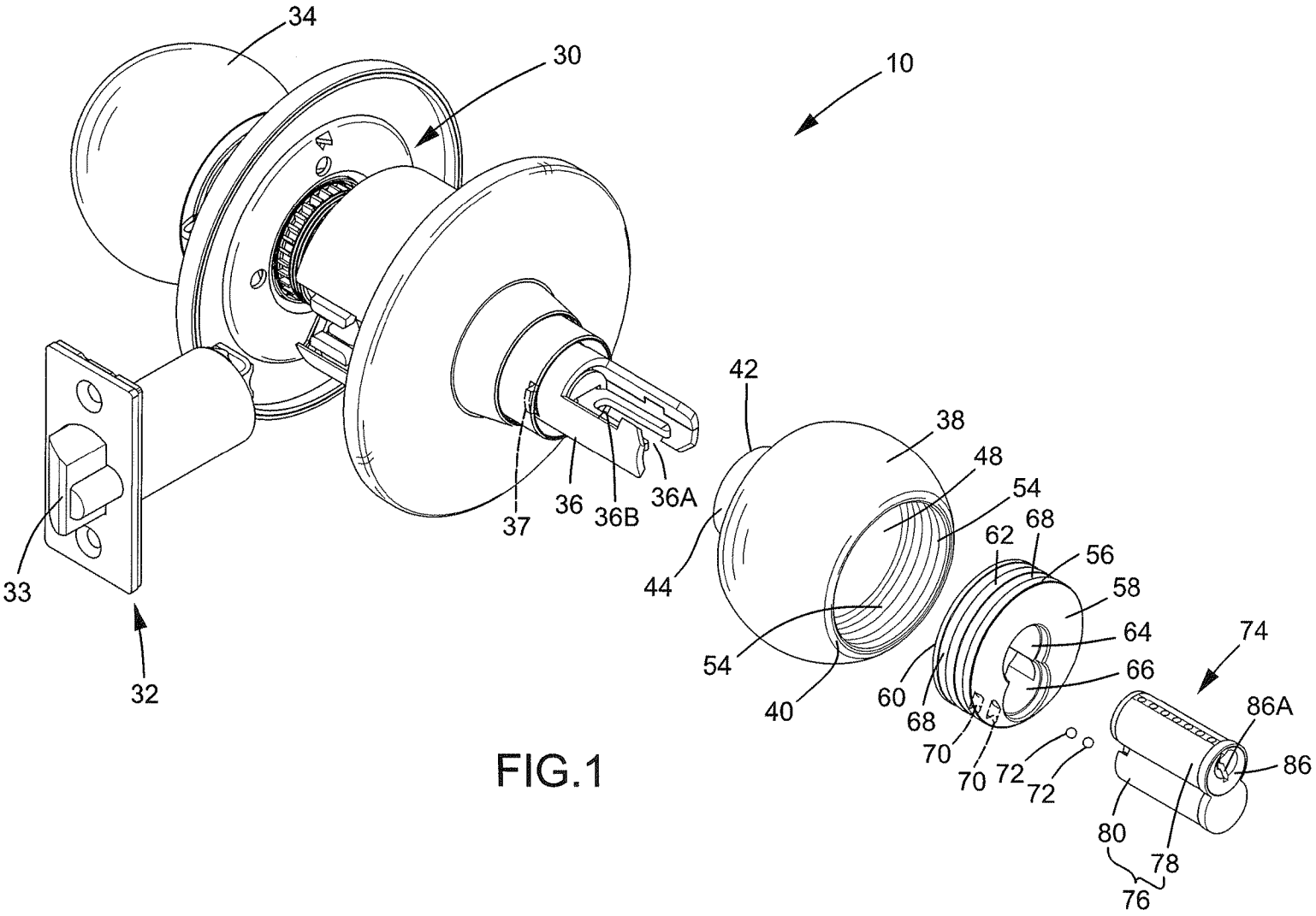
FIG. 1 is a partly exploded perspective view of a door lock of a first example according to the present invention.
Figure 2:
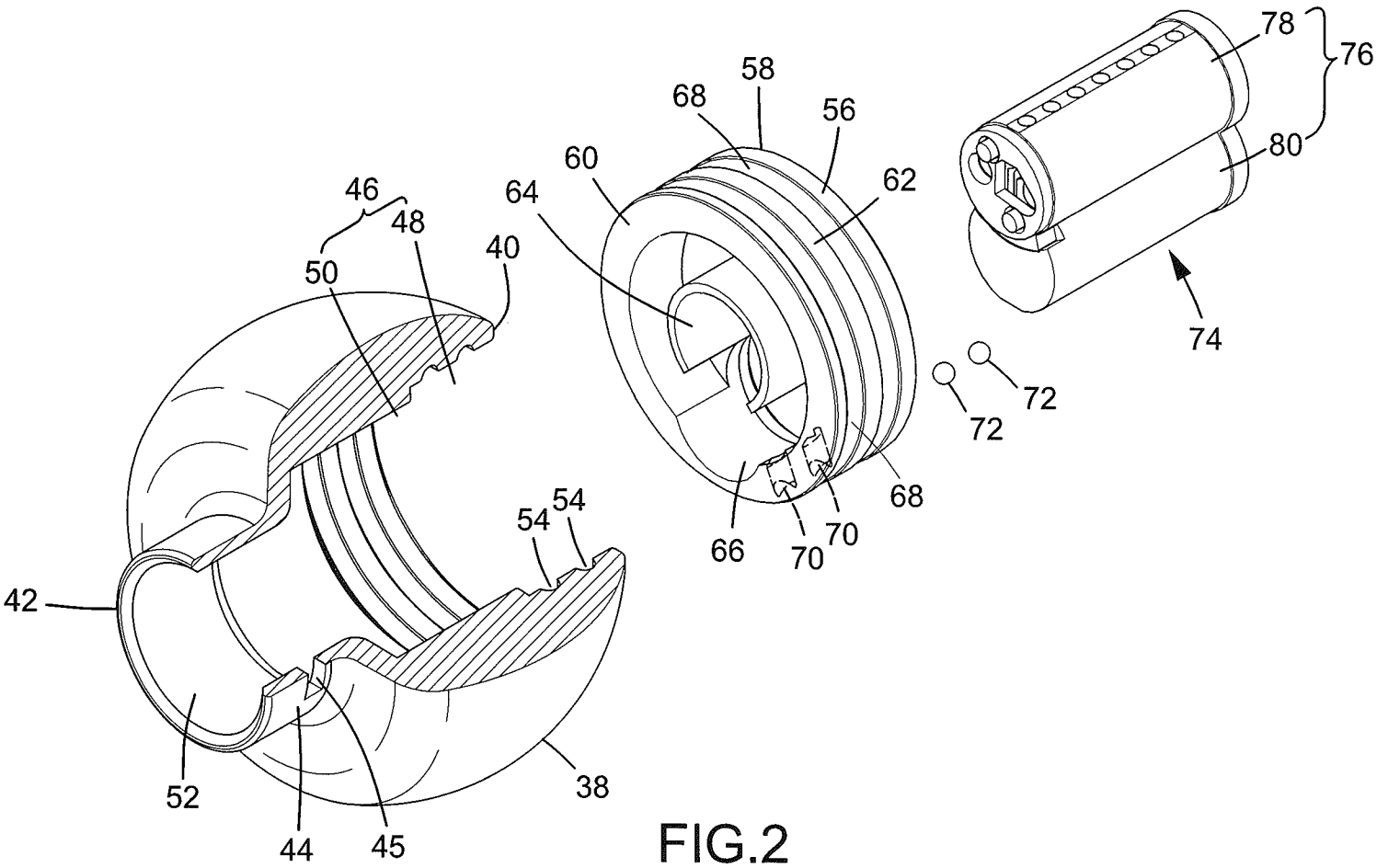
FIG. 2 is an exploded, perspective view of an outer handle, a mounting member, and a lock core of the door lock of FIG. 1.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "lower", "upper", "bottom", "side", "end", "portion", "section", "vertical", "length", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

With reference to FIGS. 1-10, a door lock 10 of a first example according to the present invention is mounted to a door 20 including a first side 22 and a second side 24 opposite to and parallel to the first side 22. Door 20 further includes first and second end faces 26 and 28 extending between first and second sides 22 and 24 and parallel to and opposite to each other.

Door lock 10 includes a driving device 30 and an inner handle 34 operably connected to driving device 30. Door lock 10 further includes an outer spindle 36 operably connected to the driving device 30. Outer spindle 36 is pivotable about a pivotal axis and includes an engagement piece 37 provided on an outer periphery thereof. Engagement piece 37 can retract in a radial direction. Two legs are provided on a distal end of outer spindle 36. A first insertion groove 36A is provided on a lower side of one of the two legs. A second insertion groove 36B is provided on an upper side of the other leg and is spaced from the first insertion groove 36A by 180° in a circumferential direction about the pivotal axis. Door lock 10 further includes a latch device 32 having a latch 33. Pivotal movement of outer spindle 36 causes movement of latch 33 between a latching position and an unlatching position.

Door lock 10 further includes an outer handle 38 coupled to and jointly pivotable with outer spindle 36. Outer handle 38 includes an outer end 40 and an inner end 42 spaced from outer end 40 along a longitudinal axis. In this embodiment, the longitudinal axis is coincident to the pivotal axis. A neck 44 is formed on inner end 42. Outer handle 38 further includes a compartment 46 extending from outer end 40 towards but spaced from inner end 42. Compartment 46 includes a first section 48 extending from outer end 40 along the longitudinal axis and a second section 50 extending from a bottom end of first section 48. Second section 50 has an inner diameter smaller than an inner diameter of first section 48. Two grooves 54 are defined in an inner periphery of first section 48 and are spaced from each other along the longitudinal axis. Grooves 54 are annular in this example. Outer handle 38 further includes an axial hole 52 extending from inner end 42 along the longitudinal axis and intercommunicating with second section 50 of compartment 46. An inner diameter of axial hole 52 is slightly larger than outer spindle 36. Neck 44 includes an engagement groove 45 extending radially inwards from an outer periphery of neck 44 and intercommunicating with axial hole 52.

Outer spindle 36 is coupled in axial hole 52 of outer handle 38. Engagement piece 37 engages with engagement groove 45 of outer handle 38. Thus, when outer handle 38 is pivoted, outer spindle 36 is actuated through transmission by engagement piece 37 to pivot about the pivotal axis, which, in turn, actuates inner components of driving device 30, thereby moving latch 33 from the latching position to the unlatching position.

Door lock 10 further includes a mounting member 56 coupled to outer handle 38. In this example, mounting member 56 has circular cross sections and includes a first end face 58 and a second end face 60 spaced from first end face 58 along the longitudinal axis and parallel to first end face 58. Mounting member 56 further includes a first hole 64 extending from first end face 58 through second end face 60 and aligned with axial hole 52 of outer handle 38. Mounting member 56 further includes a second hole 66 extending from first end face 58 through second end face 60. Second hole 66 is located on a side of and intercommunicates with first hole 64. Thus, first and second holes 64 and 66 together have substantially figure-8 shaped cross sections.

In this example, two annular grooves 68 are defined in an outer periphery 62 of mounting member 56 and are spaced from each other along the longitudinal axis. Mounting member 56 further includes two through-holes 70. Each through-hole 70 extends from an inner periphery of second hole 66 in a radial direction perpendicular to the pivotal axis to one of annular grooves 68. Each through-hole 70 is aligned with one of annular grooves 68 of mounting member 56 and one of grooves 54 of outer handle 38. Each of first and second holes 64 and 66 has a central axis. The central axes of first and second holes 64 and 66 are spaced from each other in a spacing direction. Each through-hole 70 has a central axis at a non-parallel angle to the spacing direction.

Mounting member 56 is rotatably mounted in compartment 46 of the outer handle 38. Annular grooves 68 of mounting member 56 are aligned with grooves 54 of outer handle 38 (FIG. 5), such that each annular groove 68 and the associated groove 54 together form an annular space. First end face 58 of mounting member 56 is substantially flush with outer end 40 of outer handle 38. Second end face 60 abuts an intersection of first and second sections 48 and 50.

Each of two positioning members 72 in the form of two balls is moved through one of through-holes 70 into one of the annular spaces formed by one of annular grooves 68 of mounting member 56 and one of grooves 54 of outer handle 38. Thus, each positioning member 72 is movable between mounting member 56 and outer handle 38. Since the central axis of each through-hole 70 is at a non-parallel angle to the spacing direction of the central axes of first and second holes 64 and 66, each positioning member 72 which has passed through an associated through-hole 70 falls downward due to the gravitational force and, thus, misaligns from the associated through-hole 70, preventing positioning member 72 from passing through the associated through-hole 70 in the reverse direction and subsequent disengagement from outer handle 38 and mounting member 56. Furthermore, the outer diameter of each positioning member 72 is slightly smaller than the radial length of the associated annular space defined by the associated groove 54 and the associated annular groove 68, such that positioning members 72 between outer handle 38 and mounting member 56 permit outer spindle 36 to pivot relative to outer handle 38 about the pivotal axis and prevent mounting member 56 from disengaging from outer handle 38 along the longitudinal axis.

Door lock 10 further includes a lock core 74 detachably mounted to mounting member 56. Lock core 74 includes a housing 76 having a first portion 78 and a second portion 80 parallel to and adjoining first portion 78, such that outer housing 76 has substantially figure-8 shaped cross sections. First portion 78 is pivotably received in a positioning sleeve 82 which has a lug 84 on an outer periphery thereof Lock core 74 further includes a shaft 86 rotatably mounted in positioning sleeve 82. Shaft 86 includes a keyway 86A extending from an end face through the other end face of shaft 86. Two keys can be inserted into keyway 86A. One of the keys can unlock the locking state of shaft 86 (positioning sleeve 82 remains locked and cannot pivot) and can further drive driving device 30 to move latch 33 between the latching position and the unlatching position. The other key can unlock the locking state of positioning sleeve 82 to permit joint pivotal movement of positioning sleeve 82 and shaft 86, pivoting lug 84 of positioning sleeve 82 about the pivotal axis between the extended, engagement position outside of homing 76 and the retracted, detachment position inside of housing 76.

Figure 4:
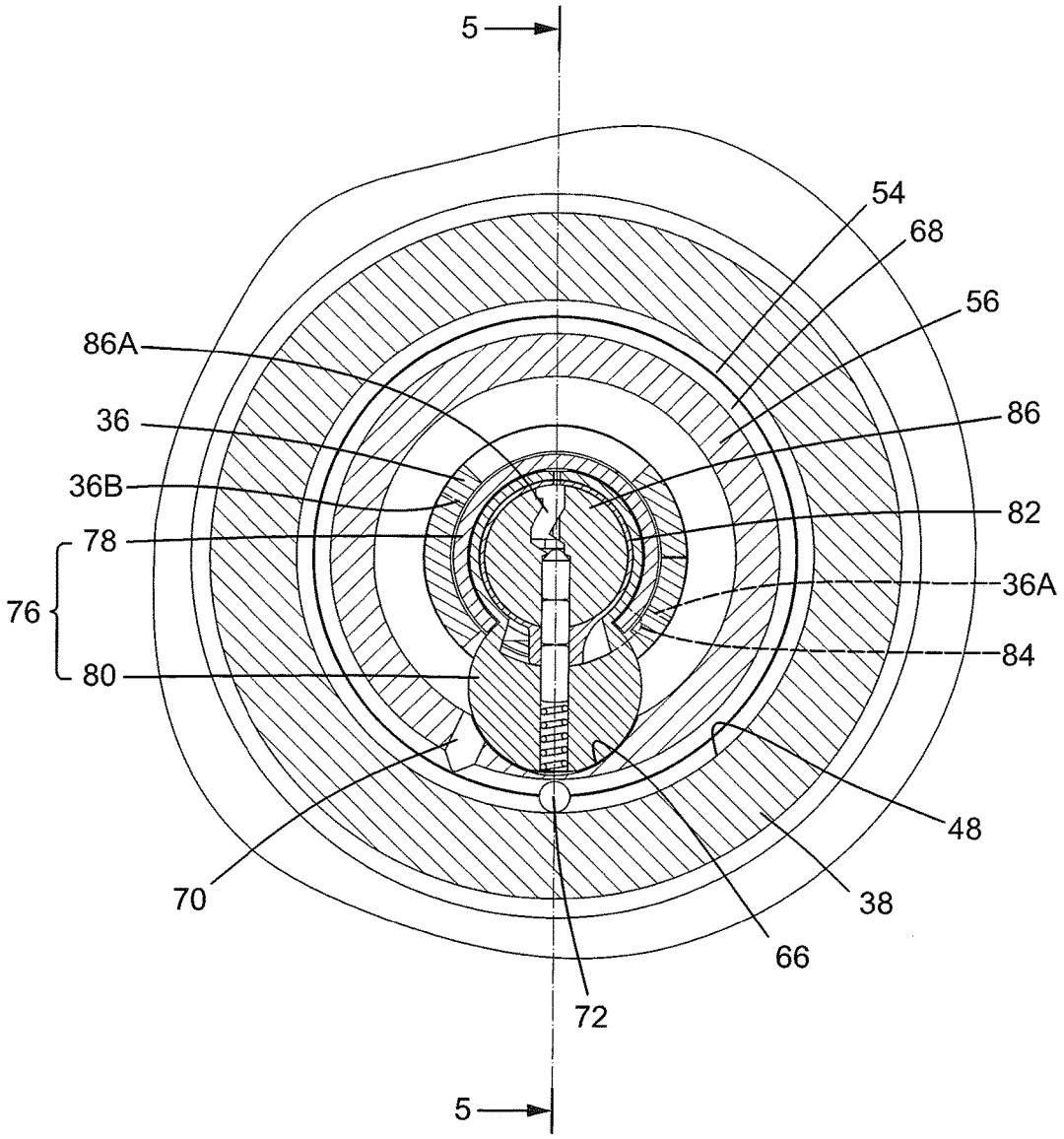
FIG. 4 is a cross sectional view taken along section line 4-4 of FIG. 3.
Figure 5:
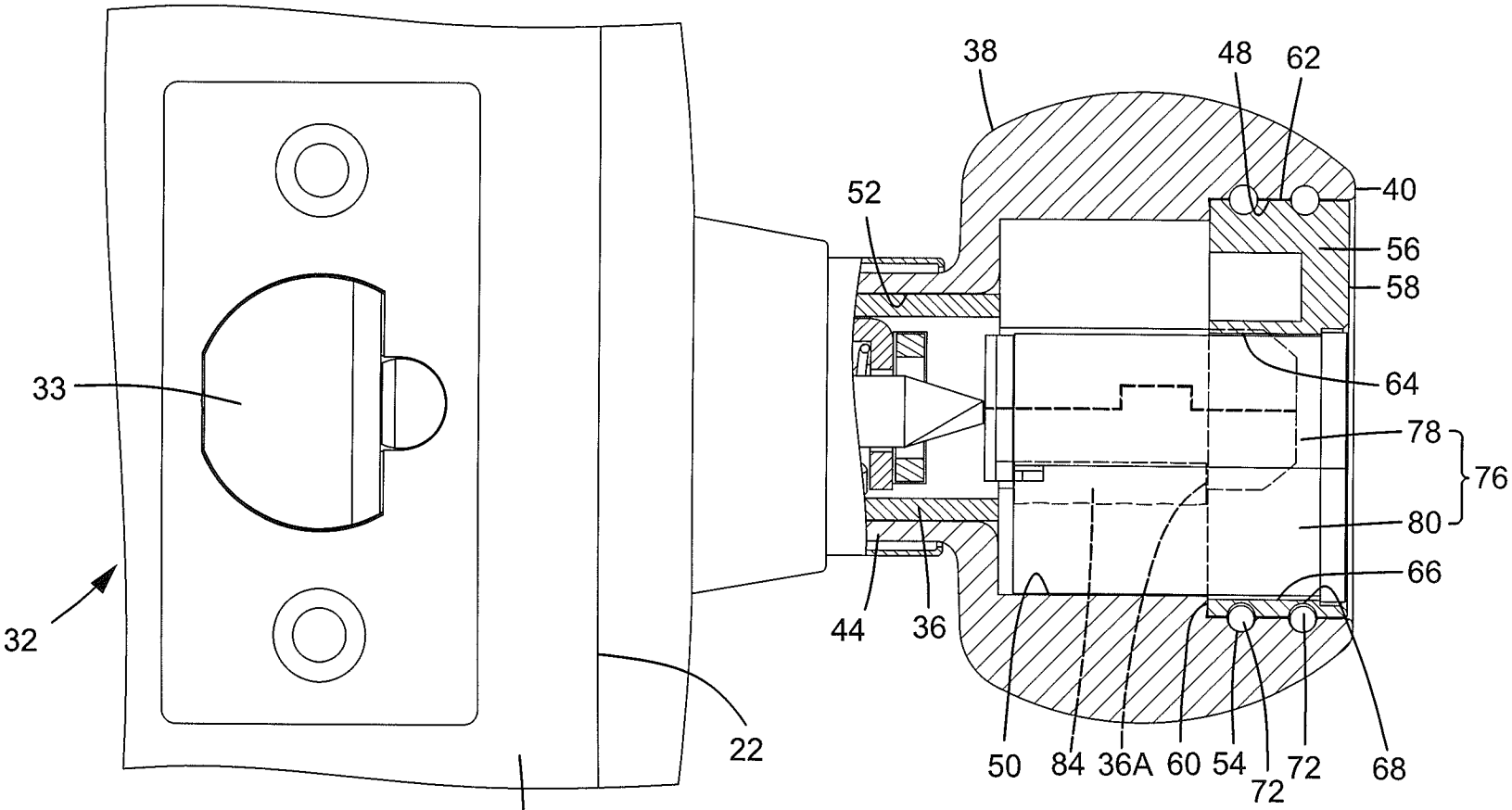
FIG. 5 is a cross sectional view taken along section line 5-5 of FIG. 4.

In a case that mounting member 56 is rotated to a position in which second hole 66 is right below first hole 64 in a vertical direction perpendicular to the longitudinal axis while lug 84 is in the retracted, detachment position, first portion 78 of lock core 74 can be inserted into first hole 64 of mounting member 56 via first end face 58 of mounting member 56, and second portion 80 is received in second hole 66. Furthermore, first portion 78 is coupled with outer spindle 36. The two legs of outer spindle 36 abut the outer periphery of second portion 80 of housing 76. Thus, lock core 74 cannot pivot relative to outer spindle 36 but can pivot jointly with outer spindle 36. Lug 84 of positioning sleeve 82 is aligned with first insertion groove 36A of outer spindle 36. An outer end face of housing 76 of lock core 74 is substantially flush with first end face 58 of mounting member 56. The key for operating positioning sleeve 82 can be used to pivot positioning sleeve 82, moving lug 84 from the retracted, detachment position to the extended, engagement position (FIGS. 4 and 5). Thus, an end of lug 84 abuts second end face 60 of mounting member 56 and an inner wall of first insertion groove 36A of outer spindle 36, such that lock core 74 cannot disengage from outer spindle 36 and mounting member 56 along the longitudinal axis. Furthermore, second portion 80 of lock core 74 is right below first portion 78. Thus, outer handle 38 can be pivoted to cause joint pivotal movement of outer spindle 36, mounting member 56, and lock core 74.

Figure 3:
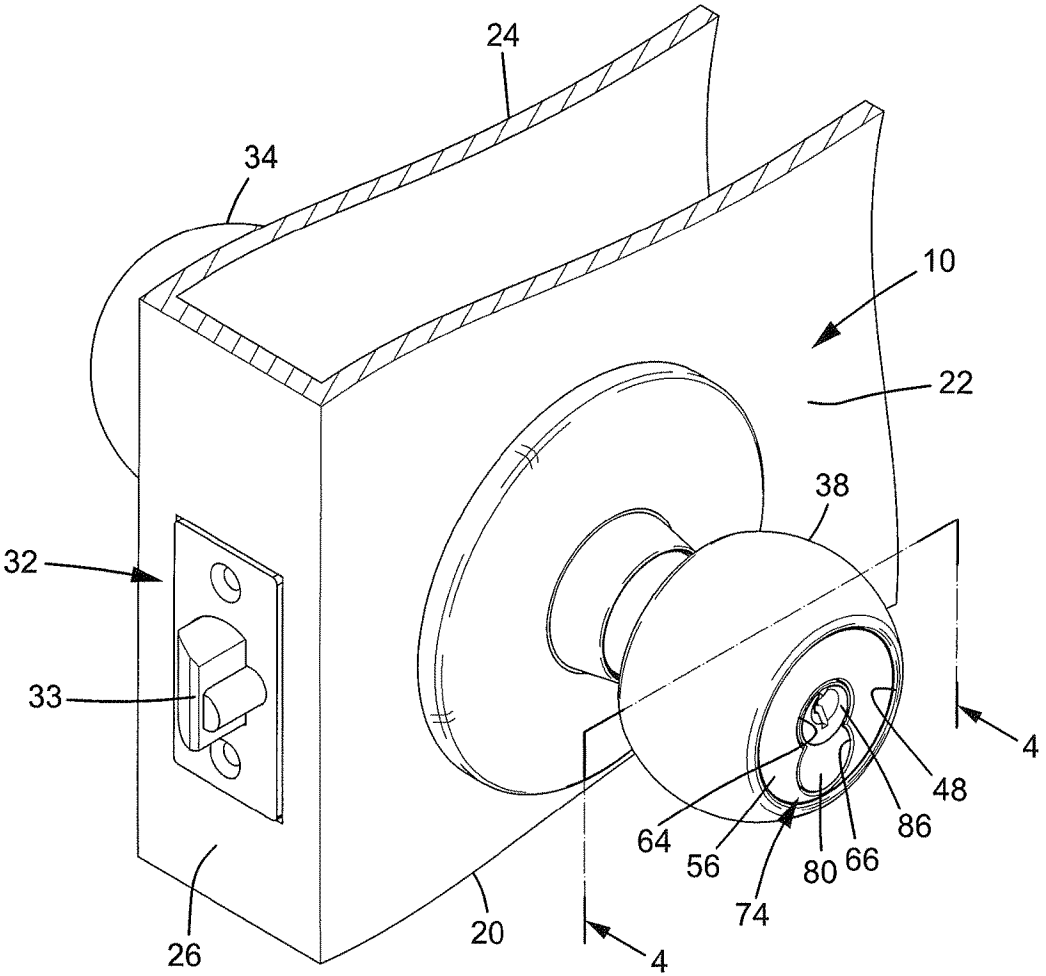
FIG. 3 is a perspective view of the door lock of FIG. 1 mounted to a first side of a door and showing that the assembly orientation of the lock core is correct.

Assume door 20 is mounted as a left-handed type (second end face 28 is pivotably connected to a door frame), and first end face 26 is movable between a closed position aligned with the door frame and an open position misaligned from the door frame. In this case, door lock 10 is mounted to a location of door 20 adjacent to first end face 26 (FIG. 3). Specifically, driving device 30 is fixed to first and second sides 22 and 24 of door 20 and is adjacent to first end face 26. Latch device 32 is fixed to first end face 26 of door 20, and latch 33 in the latching position is beyond first end face 26. An inclined face of latch 33 faces second side 24 of door 20. Inner handle 34 is on second side 24 of door 20. Outer handle 38, mounting member 56, and lock core 74 are on first side 22 of door 20. Assume that the assembly orientation of lock core 74 is that second portion 80 is right below first portion 78 after door lock 10 has been installed to door 20, the assembly orientation of lock core 74 is correct and, thus, does not need to change the assembly orientation of lock core 74. In this case, first side 22 of door 20 is deemed as the outer side, and second side 24 of door 20 is deemed as the inner side. Thus, door 20 is pivoted to open if door 20 is pushed from first side 22 towards second side 24. On the other hand, door 20 is pivoted to the closed position if door 20 is pushed from second side 24 towards first side 22.

Inner handle 34 or outer handle 38 can be pivoted to move latch 33 from the latching position to the unlatching position. If door lock 10 is set in the locking state in which outer spindle 36 and outer handle 38 cannot be pivoted (but inner handle 34 can be pivoted), the key for unlocking shaft 86 can be used to rotate shaft 86 to switch door lock 10 to the unlocked state, such that latch 33 can be moved from the latching position to the unlatching position upon pivotal movement of outer spindle 36 and outer handle 38.

Figure 6:
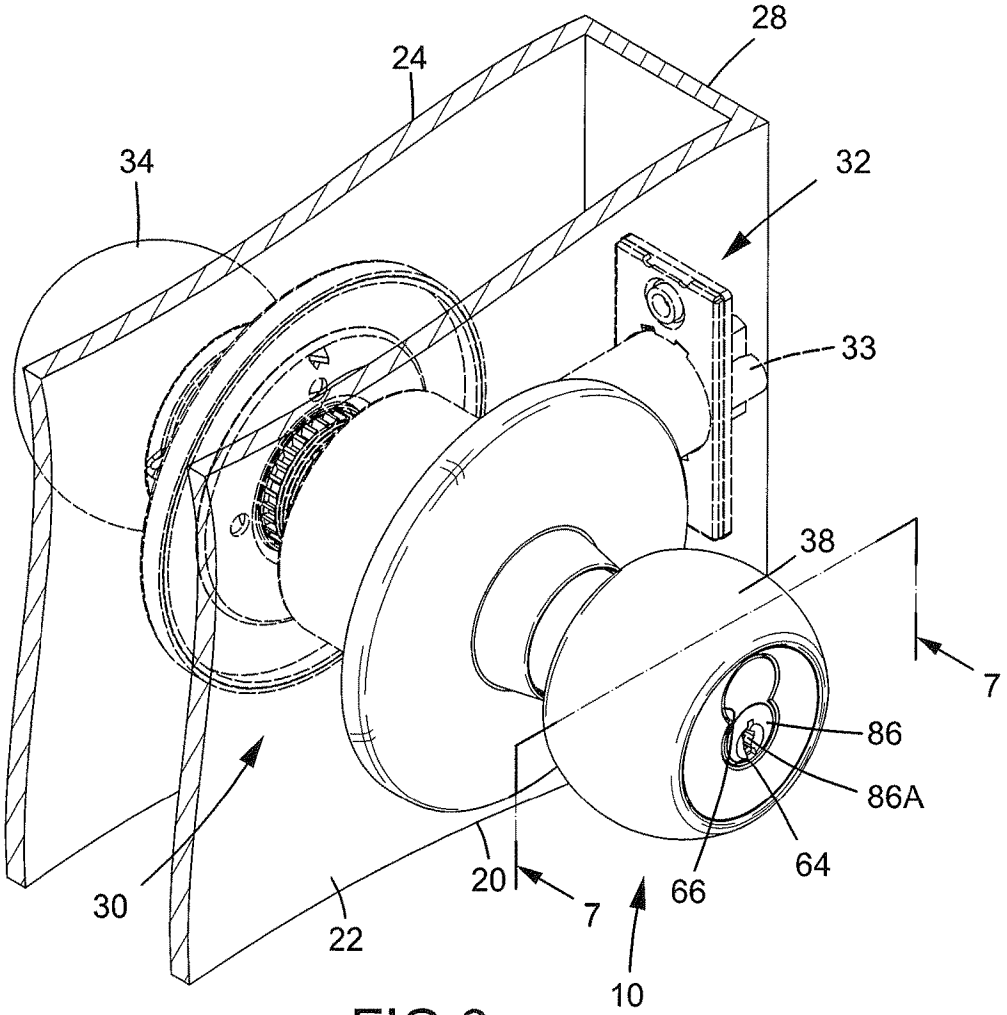
FIG. 6 is a perspective view of the door lock of FIG. 1 mounted to a second side of the door and showing that the assembly orientation of the lock core is incorrect.
Figure 7:
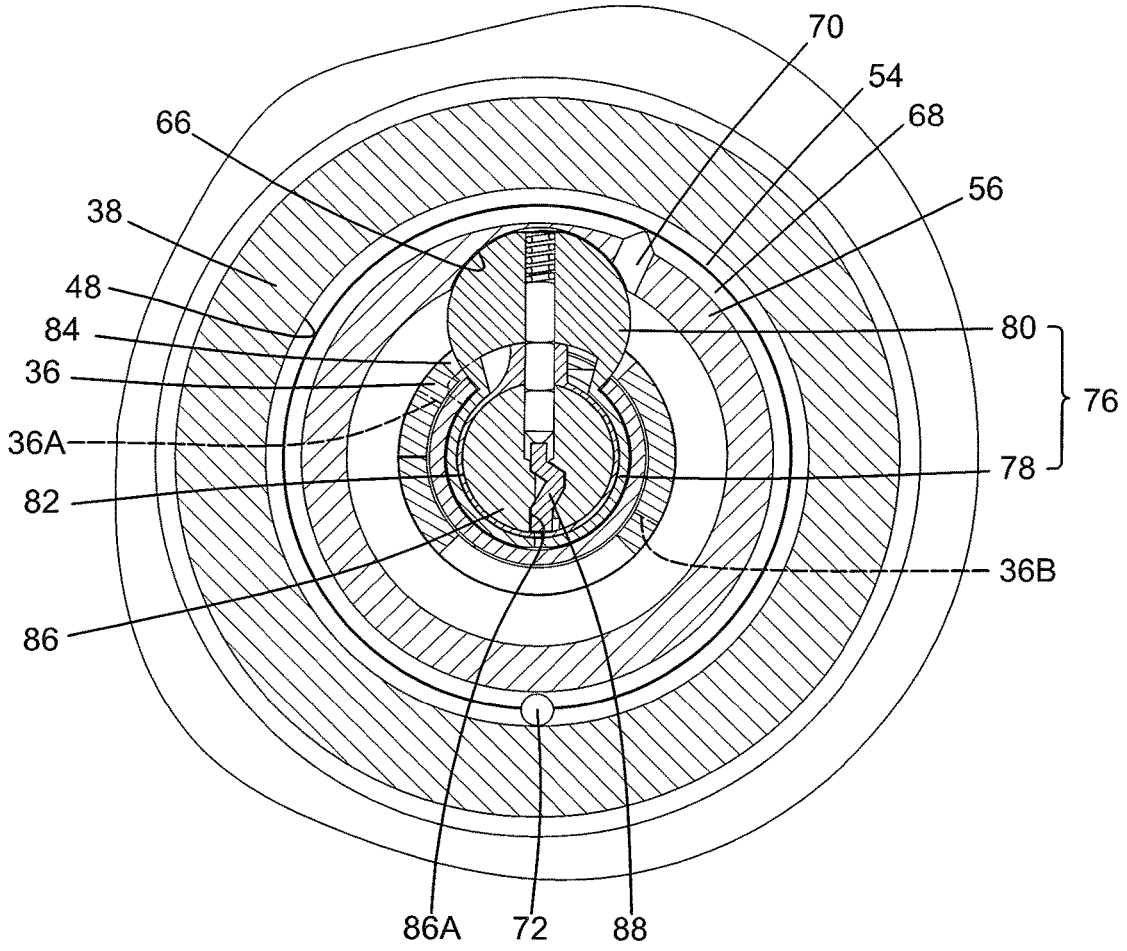
FIG. 7 is a cross sectional view taken along section line 7-7 of FIG. 6.
Figure 8:
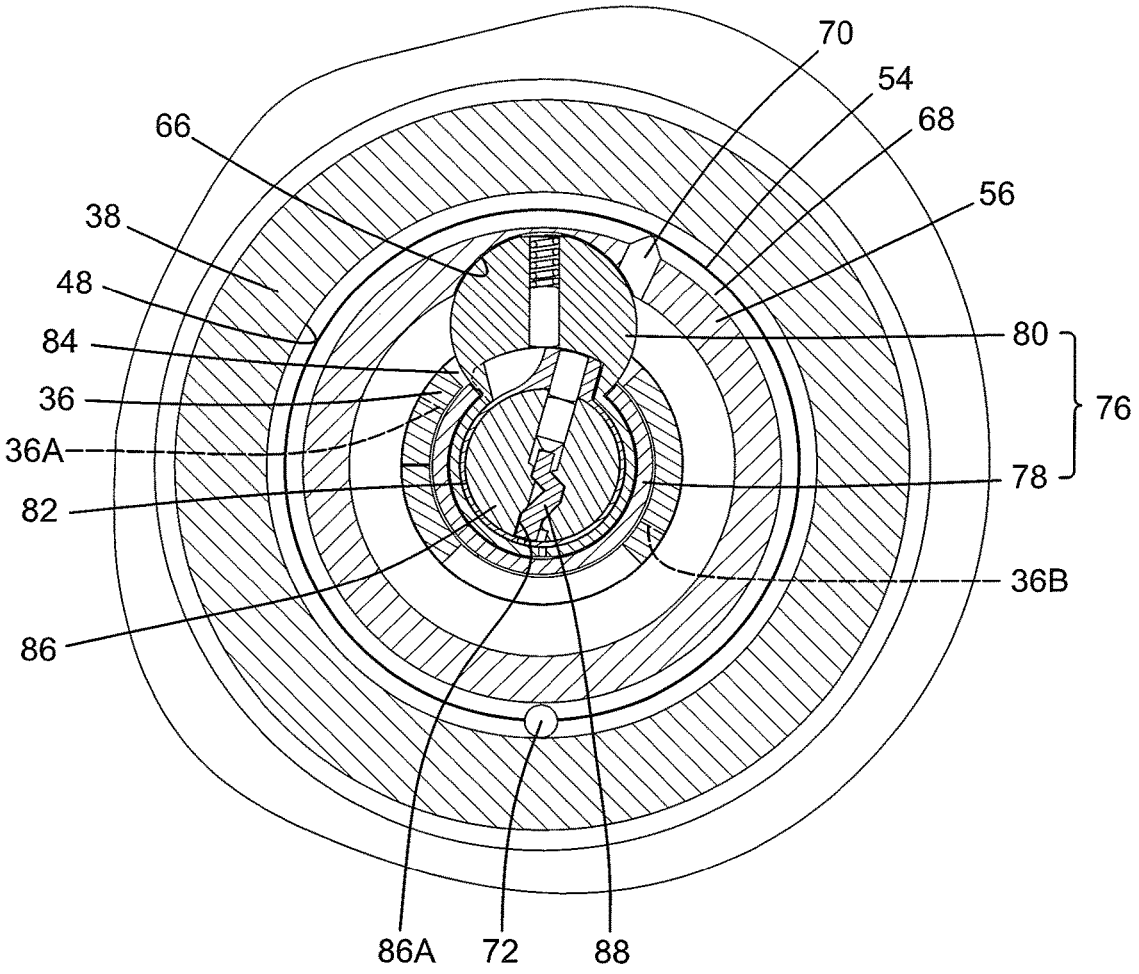
FIG. 8 is a cross sectional view similar to FIG. 7, with a lug moved from an engagement position to a detachment position by using a key for detaching the lock core.
Figure 9:
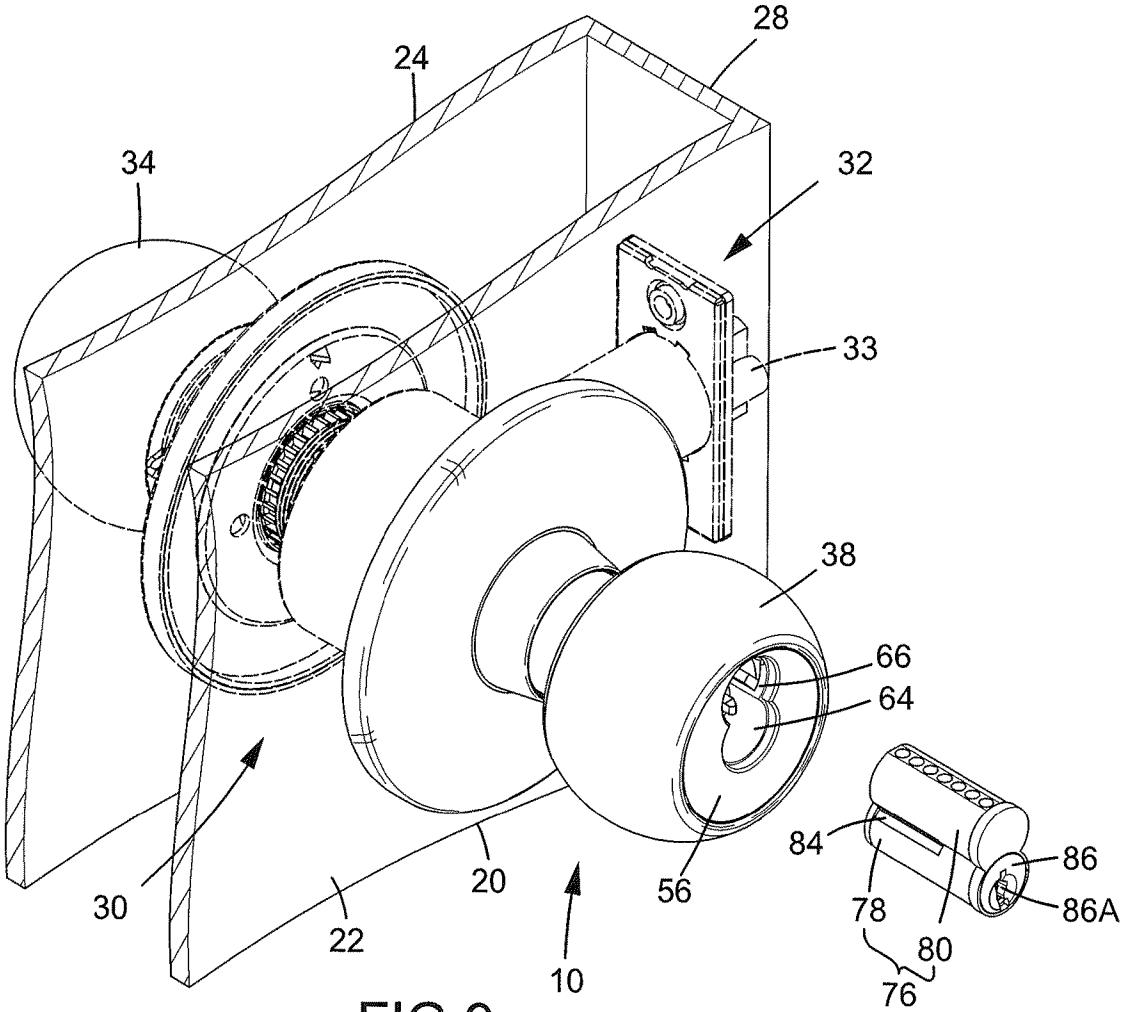
FIG. 9 is a perspective view similar to FIG. 6, with the lock core detached from the mounting member.

Given first side 22 of door 20 is the outer side and second side 24 is the inner side, if door 20 is mounted in a manner that first end face 26 is pivotably connected to the door frame while second end face 28 is movable between a closed position aligned with the door frame and an open position misaligned from the door frame, door lock 10 must be mounted to a location adjacent to second end face 28 (FIG. 6). Specifically, driving device 30 is fixed to first and second sides 22 and 24 and is located adjacent to second end face 28 of door 20, and latch device 32 is fixed to second end face 28. Latch 33 in the latching position is beyond second end face 28 of door 20. The inclined face of latch 33 faces second side 24 of door 20. Inner handle 34 is on second side 24 of door 20. Outer handle 38, mounting member 56, and lock core 74 are on first side 22 of door 20.

It can be appreciated that it is not necessary to detach components on the side of outer handle 38 during installation of door lock 10 on door 20. Since outer handle 38 and lock core 74 are assembled together, outer handle 38 is generally mounted to the outer side of door 20 to provide an anti-theft effect. Outer handle 38 cannot be detached without detaching inner handle 34 and the components on the side of the inner handle 34. Given the above arrangement, if the assembly orientation of lock core 74 is that second portion 80 is right above first portion 78 (which is the wrong direction, see FIGS. 6 and 7), it is necessary to insert the key 88 for detaching lock core into keyway 86A (FIG. 7) and then pivot the key 88 to pivot positioning sleeve 82, moving lug 84 from the extended, engagement position to the retracted, detachment position. Thus, lug 84 is spaced from first insertion groove 36A of outer spindle 36 and second end face 60 of mounting member 56, permitting lock core 74 to be disengaged from mounting member 56 and outer spindle 36 along the longitudinal axis.

Figure 10:
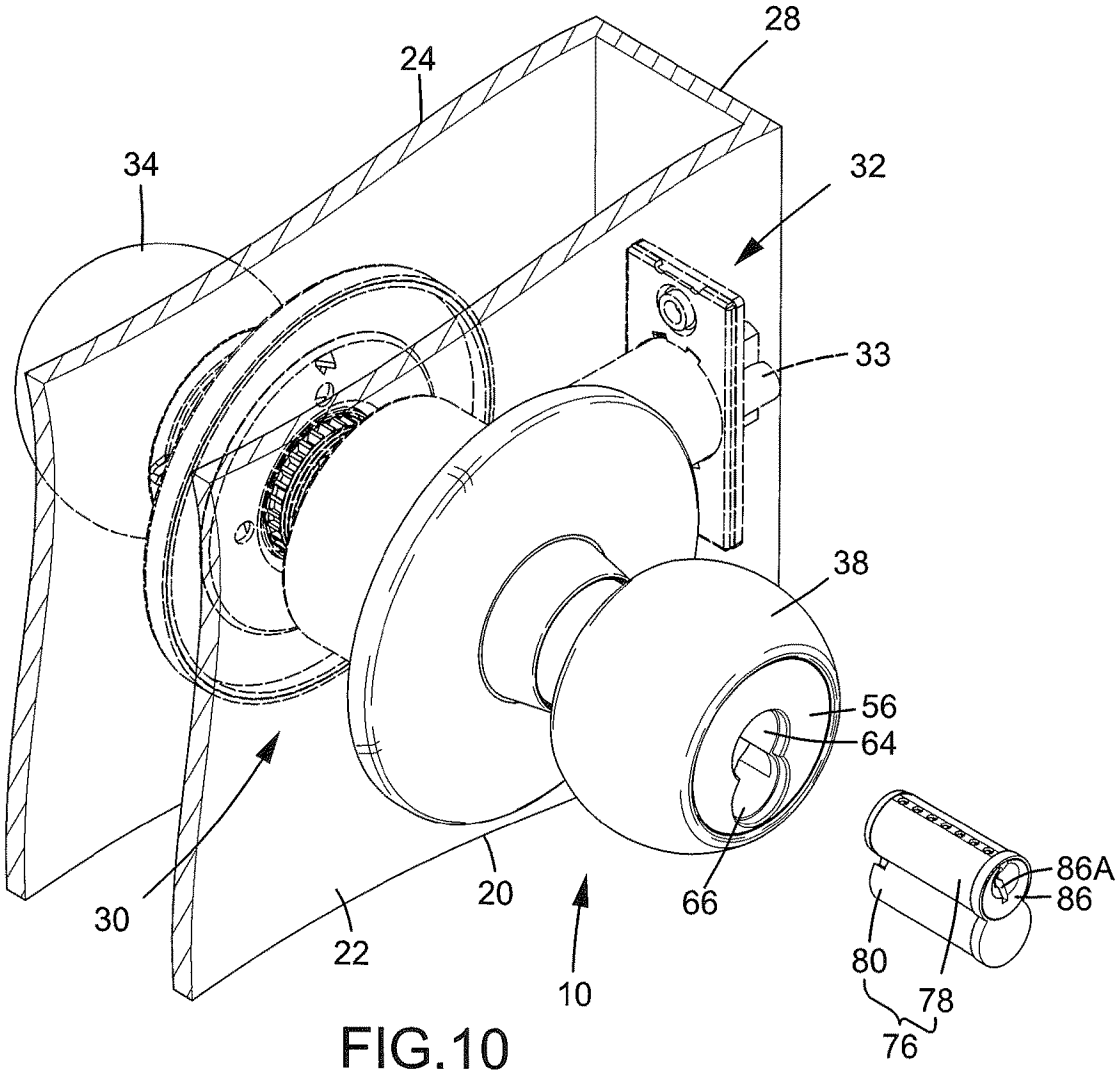
FIG. 10 is a perspective view similar to FIG. 9, with the lock core rotated 180°.

After lock core 74 restricting mounting member 56 has been detached (FIG. 9), mounting member 56 can be rotated relative to outer handle 38 about the pivotal axis until second hole 66 of mounting member 56 is right below first hole 64 (FIG. 10). Namely the positional relationship between first and second holes 64 and 66 of mounting member 56 is changed. Next, lock core 74 is reassembled with mounting member 56 and outer spindle 36. Then, key 88 is used to pivot positioning sleeve 82, moving lug 84 from the retracted, detachment position to the extended, engagement position. Thus, mounting member 56 is again restricted by lock core 74 and outer spindle 36, such that mounting member 56 can only pivot together with outer handle 38 and outer spindle 36. Furthermore, lock core 74 cannot disengage from outer spindle 36 and mounting member 56 along the longitudinal axis. Lock core 74 has been assembled to be in the correct assembly orientation in which second portion 80 is right below first portion 78. Thus, door lock 10 can be mounted to door 20 with the assembly orientation of lock core 74 remaining the same and correct.

Since door lock 10 permits the assembly orientation of lock core 74 mounted to mounting member 56 can be changed without detaching outer handle 38, manufacturers do not have to consider whether the assembly orientation of lock core 74 meets the user need, because the assembly orientation of lock core 74 can be changed by using key 88 for detaching lock core 74. Thus, door lock 10 provides enhanced convenience during installation.

Another feature of door lock 10 is that the central axis of each through-hole 70 of mounting member 56 is at a non-parallel angle with the spacing direction of the central axes of the first and second holes 64 and 66 (namely, each through-hole 70 is not directly below the associated first hole 64 or the associated second hole 66), such that each positioning member 72 which has passed through an associated through-hole 70 falls downward due to the gravitational force and, thus, misaligns from the associated through-hole 70. Thus, even if mounting member 56 is rotated before lock core 74 is mounted, it is difficult for each positioning member 72 to disengage from mounting member 56 by passing through the associated through-hole 70 in the reverse direction. The assembly of mounting member 56 and outer handle 38 is, thus, simple.

Figure 11:
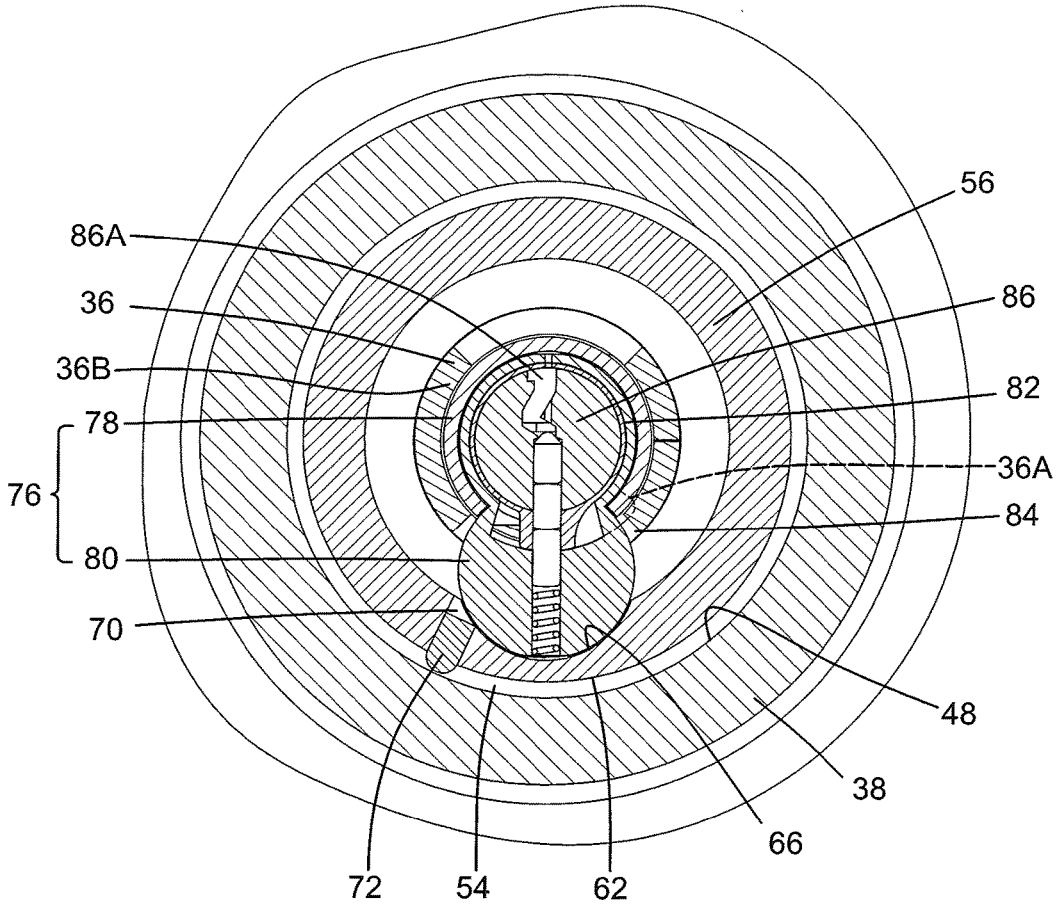
FIG. 11 is a cross sectional view of the outer handle, the mounting member, and the lock core of a second example according to the present invention.

FIG. 11 shows a door lock 10 of a second example according to the present invention. Door lock 10 of the second example is substantially the same as the first example except that mounting member 56 does not have to include the two annular grooves 68, and the two positioning members 72 are cylindrical and are engaged with through-holes 70 of mounting member 56 by tight coupling, such that each positioning member 72 has an end slideably received in one of grooves 54 of outer handle 38. The two positioning members 72 can also prevent mounting member 56 from disengaging from outer spindle 36 and outer handle 38 and can permit mounting member 56 to pivot about the pivotal axis before mounting member 56 engages with lock core 74.

Due to the feature of the rotatable mounting member 56 after detaching lock core 74, door lock 10 of the second example also permits a change in the assembly orientation of lock core 74 without detaching outer handle 38.

Now that the basic teachings of the present invention have been explained, many extensions and variations will be obvious to one having ordinary skill in the art. For example, mounting member 56 can include only one annular groove 68, outer handle 38 can include only one groove 54, and a positioning member 72 is received in the annular space defined by annular groove 68 and groove 54. Furthermore, outer handle 38, mounting member 56, lock core 74, and positioning members 72 can be of other desired forms as conventional including but not limited to of commercially available types.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. A door lock comprising:

a driving device including an outer spindle pivotable about a pivotal axis;

a latch device operably connected to the driving device, with the latch device including a latch, with pivotal movement of the outer spindle about the pivotal axis causing movement of the latch between a latching position and an unlatching position;

an outer handle including an outer end and an inner end spaced from the outer end along a longitudinal axis, with the outer handle further including a compartment extending from the outer end towards but spaced from the inner end of the outer handle, with the compartment including an inner periphery having a groove, with the outer handle further including an axial hole extending from the inner end of the outer handle and intercommunicating with the compartment, and with the outer handle coupled to and jointly pivotable with the outer spindle;

a mounting member rotatably mounted in the compartment of the outer handle, with the mounting member including a first end face and a second end face spaced from the first end face along the longitudinal axis, with the mounting member further including a first hole extending from the first end face through the second end face and aligned with the axial hole of the outer handle, with the mounting member further including a second hole extending from the first end face through the second end face, and with the second hole located on a side of and intercommunicated with the first hole;

a positioning member movably received in the groove of the outer handle, with the positioning member permitting the mounting member to pivot about the pivotal axis, and with the positioning member preventing the mounting member from moving relative to the outer handle along the longitudinal axis; and a lock core including a first portion and a second portion adjoining and extending parallel to the first portion, with the lock core detachably engaged with the mounting member, with the lock core engaged with the mounting member, the first portion of the lock core is received in the first hole of the mounting member, and the second portion of the lock core is received in the second hole of the mounting member, preventing the mounting member from pivoting about the pivotal axis relative to the outer handle, and with the lock core disengaged from the mounting member, the mounting member is pivotable about the pivotal axis relative to the outer handle to change a positional relationship between the first and second holes of the mounting member.

2. The door lock as claimed in claim 1, with the mounting member further including an outer periphery extending between the first and second end faces of the mounting member, with the mounting member further including a through-hole extending from an inner periphery of the second hole in a radial direction perpendicular to the pivotal axis through the outer periphery of the mounting member, with the through-hole aligned with the groove of the outer handle, and with the positioning member including a first end securely received in the through-hole and a second end slideably received in the groove of the outer handle.

3. The door lock as claimed in claim 1, with the mounting member further including an outer periphery extending between the first and second end faces of the mounting member, with an annular groove defined in the outer periphery of the mounting member, with the mounting member further including a through-hole extending from an inner periphery of the second hole in a radial direction perpendicular to the pivotal axis to the annular groove, with the through-hole aligned with the annular groove of the mounting member and the groove of the outer handle, and with the positioning member moving through the through-hole into a space formed by the annular groove of the mounting member and the groove of the outer handle.

4. The door lock as claimed in claim 3, with each of the first and second holes having a central axis, with the central axes of the first and second holes spaced from each other in a spacing direction, and with the through-hole having a central axis at a non-parallel angle to the spacing direction.

5. The door lock as claimed in claim 1, with the lock core including a positioning sleeve configured to be unlocked and pivoted by a key, and with the positioning sleeve including a lug formed on an outer periphery thereof, wherein the key is operable to pivot the lug between an extended, engagement position and a retracted, detachment position, with the lug in the extended, engagement position, the lug abuts the second end face of the mounting member to prevent the lock core from disengaging from the mounting member along the longitudinal axis, thereby positioning the lock core, and with the lug in the retracted, detachment position, the lug is spaced from the second end face of the mounting member to permit the lock core to move relative to the mounting member along the longitudinal axis, disengaging the lock core from the mounting member.

6. The door lock as claimed in claim 5, with the outer spindle further including a first insertion groove and a second insertion groove spaced from the first insertion groove by 180° in a circumferential direction about the pivotal axis, with the lug in the extended, engagement position, the lug abuts an inner wall of one of the first and second insertion grooves to prevent the lock core from disengaging from the mounting member along the longitudinal axis, thereby positioning the lock core, and with the lug in the retracted, detachment position, the lug is spaced from the inner walls of the first and second insertion grooves to permit the lock core to move relative to the mounting member along the longitudinal axis, disengaging the lock core from the mounting member and the outer spindle.

7. A door lock comprising:

a driving device including an outer spindle pivotable about a pivotal axis, with the driving device adapted to be mounted to a door having a first end face and a second end face opposite to the first end face, with the door further including a first side extending between the first and the second end faces, and with the outer spindle having a distal end located on an outer end of the first side of the door;

a latch device operably connected to the driving device, with the latch device including a latch, with pivotal movement of the outer spindle causing movement of the latch between a latching position and an unlatching position, and with the latch device configured to be mounted to one of the first and second end faces of the door;

an outer handle including an outer end and an inner end spaced from the outer end along a longitudinal axis of the outer spindle, with the outer handle further including a compartment extending from the outer end towards but spaced from the inner end of the outer handle, with the compartment including an inner periphery having a groove, with the outer handle further including an axial hole extending from the inner end of the outer handle and intercommunicating with the compartment, and with the outer handle coupled to and jointly pivotable with the outer spindle;

a mounting member rotatably mounted in the compartment of the outer handle, with the mounting member including a first end face and a second end face spaced from the first end face along the longitudinal axis, with the mounting member further including a first hole extending from the first end face through the second end face and aligned with the axial hole of the outer handle, with the mounting member further including a second hole extending from the first end face through the second end face, and with the second hole located on a side of and intercommunicated with the first hole;

a positioning member movably received in the groove of the outer handle, with the positioning member permitting the mounting member to pivot about the pivotal axis and preventing the mounting member from moving relative to the outer handle along the longitudinal axis; and a lock core including a first portion and a second portion adjoining and extending parallel to the first portion, with the lock core detachably engaged with the mounting member, with the lock core engaged with the mounting member, the first portion of the lock core is received in the first hole of the mounting member, and the second portion of the lock core is received in the second hole of the mounting member, preventing the mounting member from pivoting about the pivotal axis relative to the outer handle to change a positional relationship between the first and second holes of the mounting member, with the lock core disengaged from the mounting member, the mounting member is pivotable about the pivotal axis relative to the outer handle, with the latch device mounted to the first end face of the door, the second portion of the lock core is located right below the first portion of the lock core in a vertical direction perpendicular to the pivotal axis, and with the latch device mounted to the second end face of the door, the second portion of the lock core is located right below the first portion of the lock core in a vertical direction perpendicular to the pivotal axis.

8. The door lock as claimed in claim 7, with the mounting member further including an outer periphery extending between the first and second end faces of the mounting member, with the mounting member further including a through-hole extending from an inner periphery of the second hole in a radial direction perpendicular to the pivotal axis through the outer periphery of the mounting member, with the through-hole aligned with the groove of the outer handle, and with the positioning member including a first end securely received in the through-hole and a second end slideably received in the groove of the outer handle.

9. The door lock as claimed in claim 7, with the mounting member further including an outer periphery extending between the first and second end faces of the mounting member, with an annular groove defined in the outer periphery of the mounting member, with the mounting member further including a through-hole extending from an inner periphery of the second hole in a radial direction perpendicular to the pivotal axis to the annular groove, with the through-hole aligned with the annular groove of the mounting member and the groove of the outer handle, and with the positioning member moving through the through-hole into a space formed by the annular groove of the mounting member and the groove of the outer handle.

10. The door lock as claimed in claim 9, with each of the first and second holes having a central axis, with the central axes of the first and second holes spaced from each other in a spacing direction, and with the through-hole having a central axis at a non-parallel angle to the spacing direction.

11. The door lock as claimed in claim 7, with the lock core including a positioning sleeve configured to be unlocked and pivoted by a key, and with the positioning sleeve including a lug formed on an outer periphery thereof, wherein the key is operable to pivot the lug between an extended, engagement position and a retracted, detachment position, with the lug in the extended, engagement position, the lug abuts the second end face of the mounting member to prevent the lock core from disengaging from the mounting member along the longitudinal axis, thereby positioning the lock core, and with the lug in the retracted, detachment position, the lug is spaced from the second end face of the mounting member to permit the lock core to move relative to the mounting member along the longitudinal axis, disengaging the lock core from the mounting member.

12. The door lock as claimed in claim 11, with the outer spindle further including a first insertion groove and a second insertion groove spaced from the first insertion groove by 180° in a circumferential direction about the pivotal axis, with the lug in the extended, engagement position and with the latch device mounted to the first end face of the door, the lug abuts an inner wall of the first insertion groove to prevent the lock core from disengaging from the mounting member along the longitudinal axis, thereby positioning the lock core, with the lug in the extended, engagement position and with the latch device mounted to the second end face of the door, the lug abuts an inner wall of the second insertion groove to prevent the lock core from disengaging from the mounting member along the longitudinal axis, thereby positioning the lock core, with the lug in the retracted, detachment position and with the latch device mounted to the first end face of the door, the lug is spaced from the inner wall of the first insertion groove to permit the lock core to move relative to the mounting member along the longitudinal axis, disengaging the lock core from the mounting member and the outer spindle, with the lug in the retracted, detachment position and with the latch device mounted to the second end face of the door, the lug is spaced from the inner wall of the second insertion groove to permit the lock core to move relative to the mounting member along the longitudinal axis, disengaging the lock core from the mounting member and the outer spindle.

* * * * *